US010636603B2

(12) United States Patent
Takahashi et al.

(10) Patent No.: US 10,636,603 B2
(45) Date of Patent: Apr. 28, 2020

(54) ELECTROMAGNETIC RELAY

(71) Applicant: FUJITSU COMPONENT LIMITED, Tokyo (JP)

(72) Inventors: Kohei Takahashi, Tokyo (JP); Masahiro Kaneko, Tokyo (JP); Nobuo Yatsu, Tokyo (JP); Yayoi Tokuhara, Tokyo (JP); Katsuaki Koshimura, Tokyo (JP); Chuqi Liang, Tokyo (JP); Miki Kitahara, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 83 days.

(21) Appl. No.: 15/703,211

(22) Filed: Sep. 13, 2017

(65) Prior Publication Data

US 2018/0114658 A1 Apr. 26, 2018

(30) Foreign Application Priority Data

Oct. 20, 2016 (JP) ..... 2016-205833

(51) Int. Cl.
*H01H 3/60* (2006.01)
*H01H 50/56* (2006.01)
(Continued)

(52) U.S. Cl.
CPC ..... *H01H 50/56* (2013.01); *H01H 50/24* (2013.01); *H01H 50/28* (2013.01);
(Continued)

(58) Field of Classification Search
CPC ..... H01H 50/04; H01H 50/045; H01H 50/56; H01H 50/18; H01H 51/01; H01H 45/02
(Continued)

(56) References Cited

U.S. PATENT DOCUMENTS 3,012,117 A * 12/1961 Bernier ..... H01H 50/56 335/133
3,497,841 A * 2/1970 Marvin ..... H01H 51/01 335/179
(Continued)

FOREIGN PATENT DOCUMENTS

CN 201478205 U 5/2010
JP 62-66527 3/1987
(Continued)

OTHER PUBLICATIONS

Japanese Platform for Patent Information English abstract for Japanese Patent Publication No. 6-52774, published Feb. 25, 1994.
(Continued)

*Primary Examiner* — Shawki S Ismail
*Assistant Examiner* — Lisa N Homza
(74) *Attorney, Agent, or Firm* — Staas & Halsey LLP

(57) ABSTRACT

An electromagnetic relay including: an electromagnet; an armature that swings by energization and non-energization of the electromagnet; a first fixed terminal on which a first fixed contact is mounted; a first movable spring on which a first movable contact opposite to the first fixed contact is mounted, and that is fixed to the armature; a second movable spring that moves along with the first movable spring in response to the swinging of the armature; and an elastic member that is mounted on at least one of the first movable spring and the second movable spring, and is disposed between the first movable spring and the second movable spring.

5 Claims, 12 Drawing Sheets

(51) Int. Cl.

| | |
|---|---|
| ***H01H 50/60*** | (2006.01) |
| ***H01H 50/28*** | (2006.01) |
| ***H01H 50/30*** | (2006.01) |
| ***H01H 50/24*** | (2006.01) |
| *H01H 50/26* | (2006.01) |
| *H01H 50/14* | (2006.01) |

(52) U.S. Cl.
CPC ..... *H01H 50/305* (2013.01); *H01H 50/60* (2013.01); *H01H 50/14* (2013.01); *H01H 50/26* (2013.01); *H01H 50/30* (2013.01)

(58) Field of Classification Search
USPC ..... 335/193
See application file for complete search history.

(56) References Cited

U.S. PATENT DOCUMENTS

| | | | | |
|---|---|---|---|---|
| 4,323,945 | A | 4/1982 | Sauer | |
| 4,910,484 | A | 3/1990 | Shikano et al. | |
| 2012/0092099 | A1* | 4/2012 | Horii | H01H 50/043 335/189 |
| 2015/0055268 | A1* | 2/2015 | Chapel | H01H 47/02 361/160 |
| 2015/0279600 | A1* | 10/2015 | Hiraiwa | H01H 50/546 335/189 |
| 2016/0300679 | A1* | 10/2016 | Yamagata | H01H 50/56 |
| 2018/0012717 | A1* | 1/2018 | Kohinata | H01H 45/02 |
| 2018/0068818 | A1* | 3/2018 | Itoda | H01H 9/44 |
| 2018/0114658 | A1* | 4/2018 | Takahashi | H01H 50/24 |
| 2018/0166240 | A1* | 6/2018 | Daikoku | H01H 50/02 |
| 2018/0286616 | A1* | 10/2018 | Yatsu | H01H 50/56 |

FOREIGN PATENT DOCUMENTS

| | | |
|---|---|---|
| JP | 6-52774 | 2/1994 |
| JP | 6-60786 | 3/1994 |

OTHER PUBLICATIONS

Espacenet English abstract for Chinese Patent Application No. 201478205 U, published May 19, 2010.

Chinese Office Action dated Dec. 11, 2018 in corresponding Chinese Patent Application No. 201710980854.4.

Japanese Platform for Patent Information English abstract for Japanese Patent Publication No. 62-66527, published Mar. 26, 1987.

Japanese Platform for Patent Information English abstract for Japanese Patent Publication No. 6-60786, published Mar. 4, 1994.

Chinese Office Action dated Jul. 23, 2019 in corresponding Chinese Patent Application No. 201710980854.4.

* cited by examiner

ELECTROMAGNETIC RELAY

CROSS-REFERENCE TO RELATED APPLICATION

This application is based upon and claims the benefit of priority of the prior Japanese Patent Application No. 2016-205833 filed on Oct. 20, 2016, the entire contents of which are incorporated herein by reference.

FIELD

A certain aspect of the embodiments is related to an electromagnetic relay.

BACKGROUND

In an electromagnetic relay, each of collision between a movable contact and a fixed contact and collision between an armature and an iron core causes an operating sound. To reduce the operating sound, there has been known an electromagnetic relay in which a movable contact spring and a braking spring are mounted on the armature, a braking force is given to the armature by a resultant spring force which occurs after closure of the movable contact spring and the fixed contact, and a magnetic gap is formed between the armature and the iron core, thereby eliminating a collision sound between the armature and the iron core (see Patent Document 1: Japanese Laid-open Patent Publication No. 62-66527).

Especially, in an electromagnetic relay used in the field of electric vehicles, the electromagnetic relay having a small operating sound is required. For this reason, an electromagnetic relay having a double cover structure is known in order to reduce the operating sound of the electromagnetic relay.

SUMMARY

According to an aspect of the present invention, there is provided an electromagnetic relay including: an electromagnet; an armature that swings by energization and non-energization of the electromagnet; a first fixed terminal on which a first fixed contact is mounted; a first movable spring on which a first movable contact opposite to the first fixed contact is mounted, and that is fixed to the armature; a second movable spring that moves along with the first movable spring in response to the swinging of the armature; and an elastic member that is mounted on at least one of the first movable spring and the second movable spring, and is disposed between the first movable spring and the second movable spring.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In a conventional electromagnetic relay, in addition to the operating sound of the electromagnetic relay, there is a sound generated by the vibration of a substrate on which the electromagnetic relay are implemented. The vibration generated by the collision between the movable contact and the fixed contact and the collision between the armature and the iron core is transmitted from the electromagnetic relay to the substrate, and therefore the sound by the vibration of the substrate is generated.

In the electromagnetic relay of the Patent Document 1, the braking spring is only mounted on the movable contact spring, and therefore the electromagnetic relay does not have a structure to positively reduce the vibration and does not obtain a sufficient effect. In order to reduce the sound caused by the vibration of the substrate, it is necessary to actively suppress the vibration transmitted from the electromagnetic relay to the substrate.

A description will now be given of embodiments according to the present invention with reference to drawings.

First Embodiment

Figure 1:
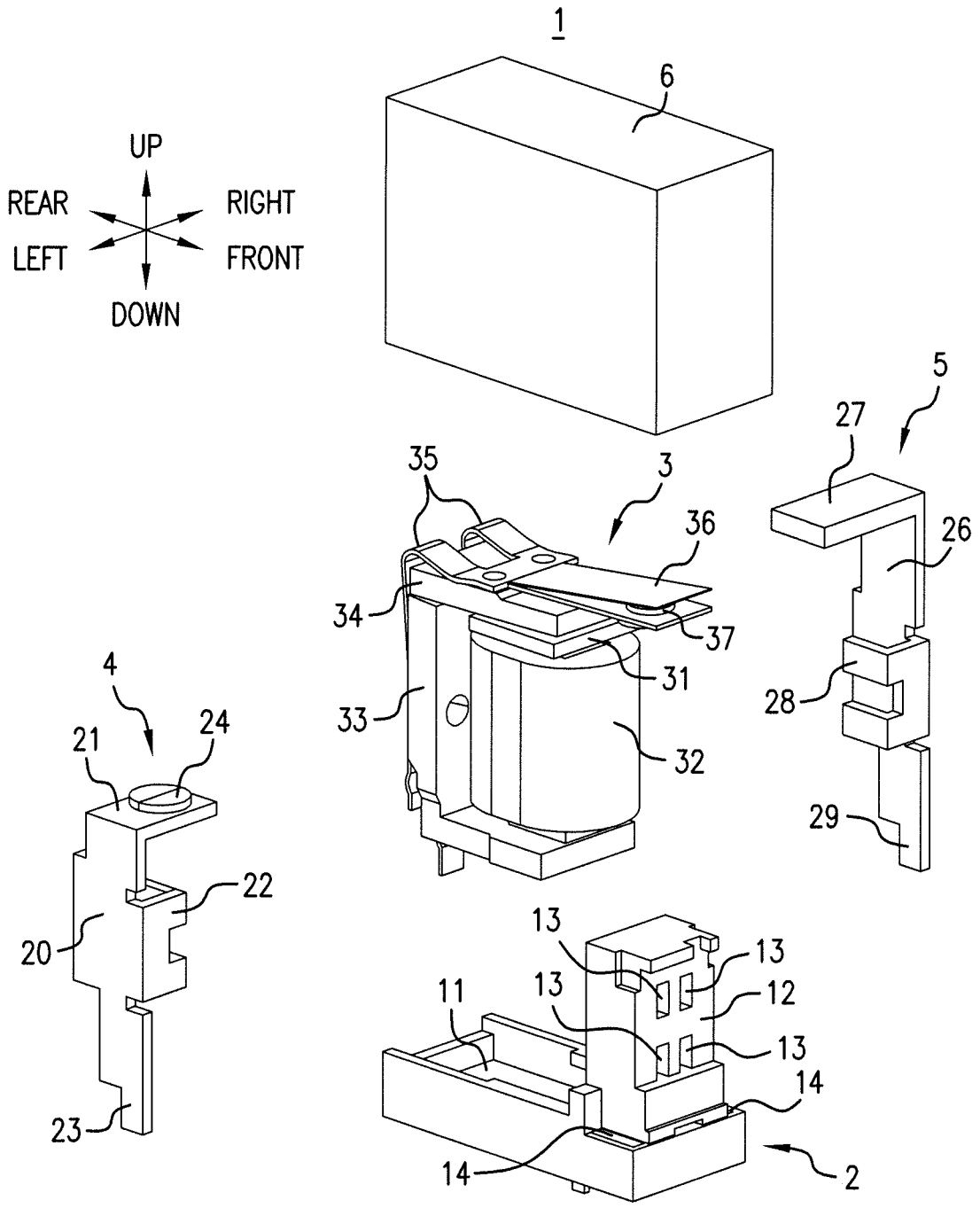
FIG. 1 is an exploded perspective view of an electromagnetic relay according to a first embodiment.
Figure 2A:
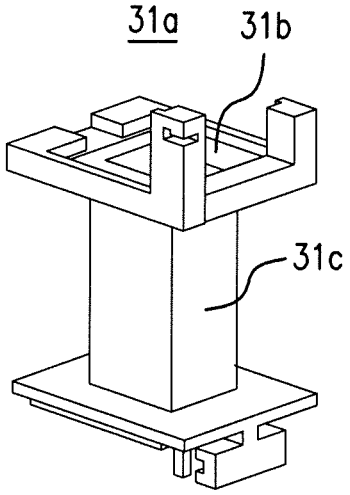
FIG. 2A is a diagram of a variation of a winding frame.
Figure 2B:
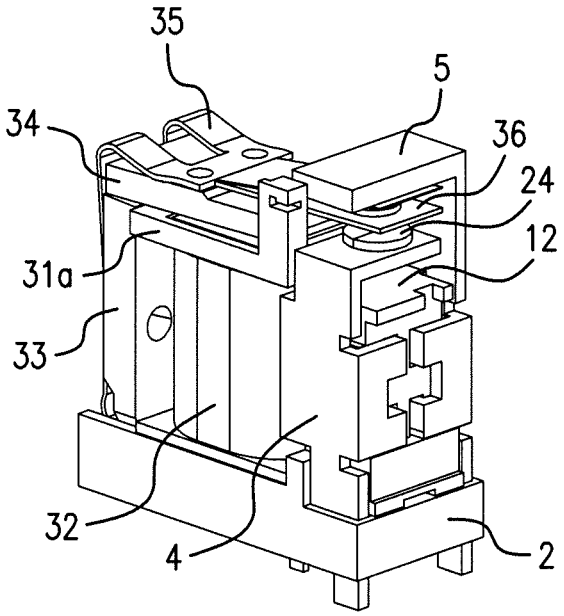
FIG. 2B is a perspective view of the electromagnetic relay.
Figure 3:
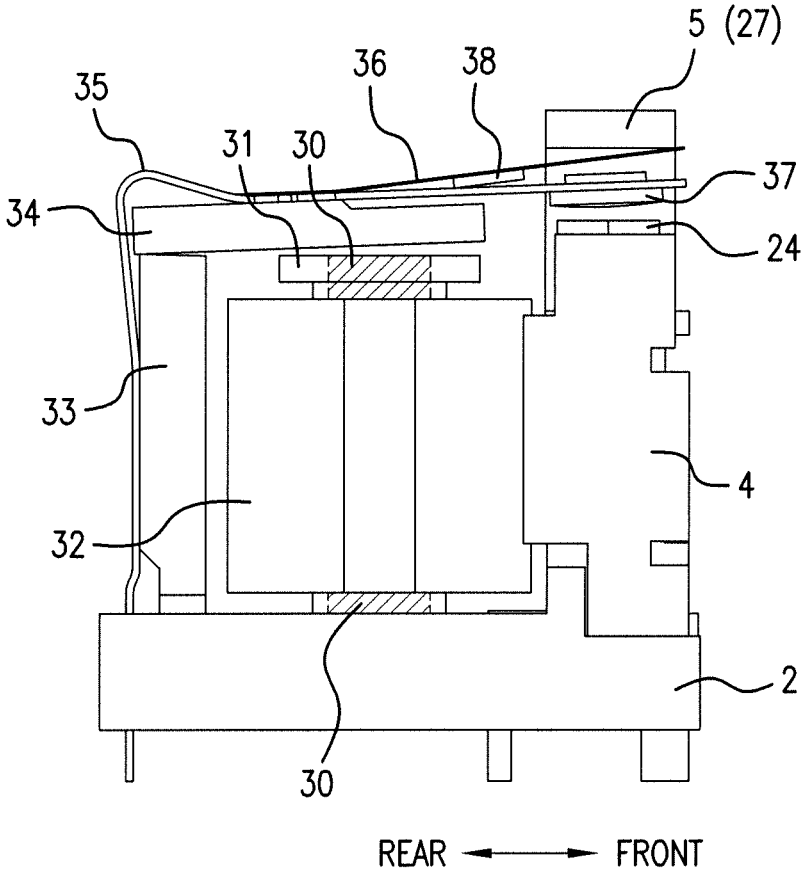
FIG. 3 is a side view of the electromagnetic relay.

FIG. 1 is an exploded perspective view of an electromagnetic relay according to a first embodiment. FIG. 2A is a diagram of a variation of a winding frame. FIG. 2B is a perspective view of the electromagnetic relay. FIG. 3 is a side view of the electromagnetic relay. In the following, for convenience, front and rear directions, right and left directions and up and down directions are defined as illustrated in FIG. 1, and a description will be given of the configuration of each part according to this.

The electromagnetic relay 1 according to a first embodiment is used for a hybrid vehicle equipped with a battery of DC 48V, for example. Specifically, the electromagnetic relay according to the present embodiment is used for the opening and closing control of a control circuit of the DC 48V battery, and can also be used for various other applications.

The electromagnetic relay 1 is a hinge type sealed relay, and includes a base block 2, an electromagnet unit 3, a first fixed terminal 4, a second fixed terminal 5, and a cover 6. The cover 6 covers, from above, the base block 2 on which the electromagnet unit 3, the first fixed terminal 4 and the second fixed terminal 5 are mounted.

The base block 2 is an electrically insulating resin molded product, and includes: a recess 11 that fixes the electromagnet unit 3, a protruding part 12 having holes 13 for fixing the first fixed terminal 4 and the second fixed terminal 5; and through-holes 14 into which the first fixed terminal 4 and the second fixed terminal 5 are inserted.

The first fixed terminal 4 is a conductive member formed by punching a copper plate and bending the punched copper plate, for example. The first fixed terminal 4 includes: a vertical part 20 extending vertically along the protruding part 12; a flat plate part 21 that is bent in a horizontal direction from an upper end of the vertical part 20; and a claw part 22 that is bent frontward at a substantially right angle from a position slightly upward from the center of the vertical part 20, and is extended in a forked shape by bending at a right angle so as to be opposite to the vertical part 20. A first fixed contact 24 is formed on an upper surface of the flat plate part 21. A lower end 23 of the vertical part 20 passes through the through-hole 14, and is fixed to a substrate, not shown. The claw part 22 is inserted into the holes 13 formed in the protruding part 12. Thus, the vertical part 20 passes through the through-hole 14 and the claw part 22 is inserted into the hole 13, and hence the first fixed terminal 4 is fixed to the base block 2.

The second fixed terminal 5 is a conductive member formed by punching a copper plate and bending the punched copper plate, for example. The second fixed terminal 5 includes: a vertical part 26 extending vertically along the protruding part 12; a flat plate part 27 that is bent in the horizontal direction from an upper end of the vertical part 26, and is opposite to the flat plate part 21; and a claw part 28 that is bent frontward at the substantially right angle from the substantially center of the vertical part 26, and is extended in the forked shape by bending at the right angle so as to be opposite to the vertical part 26. A second fixed contact may be formed on a lower surface of the flat plate part 27. A lower end 29 of the vertical part 26 passes through the through-hole 14, and is fixed to the substrate. The claw part 28 is inserted into the holes 13 formed in the protruding part 12. The vertical part 26 passes through the through-hole 14 and the claw part 28 is inserted into the hole 13, and hence the second fixed terminal 5 is fixed to the base block 2.

The electromagnet unit 3 includes: a winding frame 31 housing an iron core 30; a coil 32 mounted on an outer circumference of the winding frame 31; a yoke 33 that has a cross-section surface bent in an L-shape and is connected to one end of the iron core 30 housed in the winding frame 31; and an armature 34 that is disposed substantially horizontally above the winding frame 31 and the iron core 30, and is swingablly supported by contacting an upper end of the yoke 33. The iron core 30, the winding frame 31 and the coil 32 composed of an electromagnet. Moreover, the electromagnet unit 3 includes: a first movable spring 35 that is fixed to the yoke 33 and the armature 34 by caulking, functions as an elastic hinge between the yoke 33 and the armature 34, and is biased in a direction away from the winding frame 31 and the iron core 30; and a second movable spring 36 that includes an elastic member 38 and suppresses the vibration of the first movable spring 35.

The second movable spring 36 is disposed on the first movable spring 35. A rear end of the second movable spring 36 is fixed to the armature 34 by caulking along with the first movable spring 35. A front end of the second movable spring 36 is a free end. The front ends of the first movable spring 35 and the second movable spring 36 are disposed between the flat plate part 27 of the second fixed terminal 5 and the first fixed contact 24. An elastic member 38 is disposed between the first movable spring 35 and the second movable spring 36.

In FIG. 2B, a winding frame 31*a* illustrated in FIG. 2A is used instead of the winding frame 31 illustrated in FIGS. 1 and 3. The winding frame 31*a* includes a through-hole 31*b* for inserting the iron core 30, and a body part 31*c* for winding the coil 32. In the following description, the winding frame 31 is used.

Figure 4B:
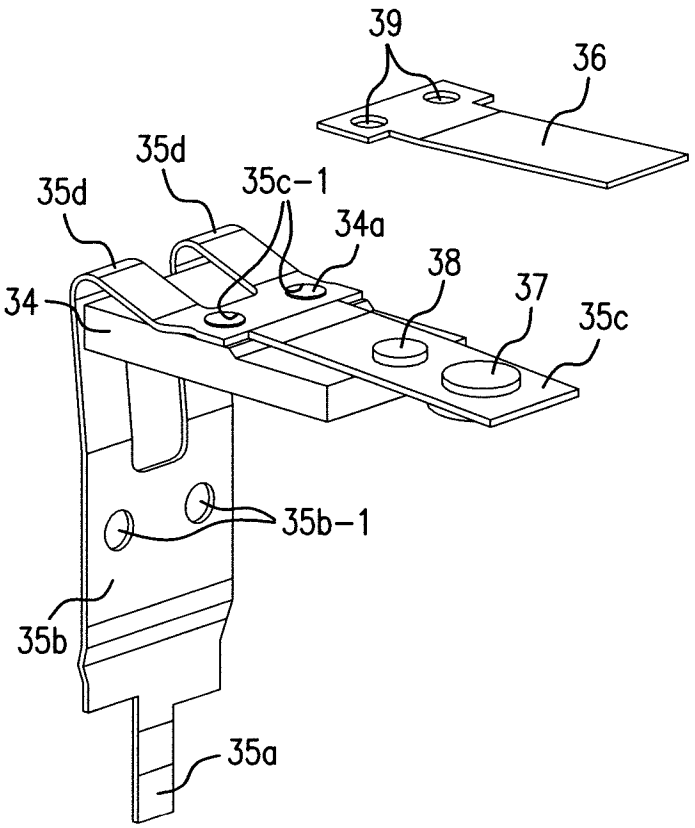
FIG. 4B is a perspective view illustrating a variation of the first movable spring and the second movable spring.
Figure 4A:
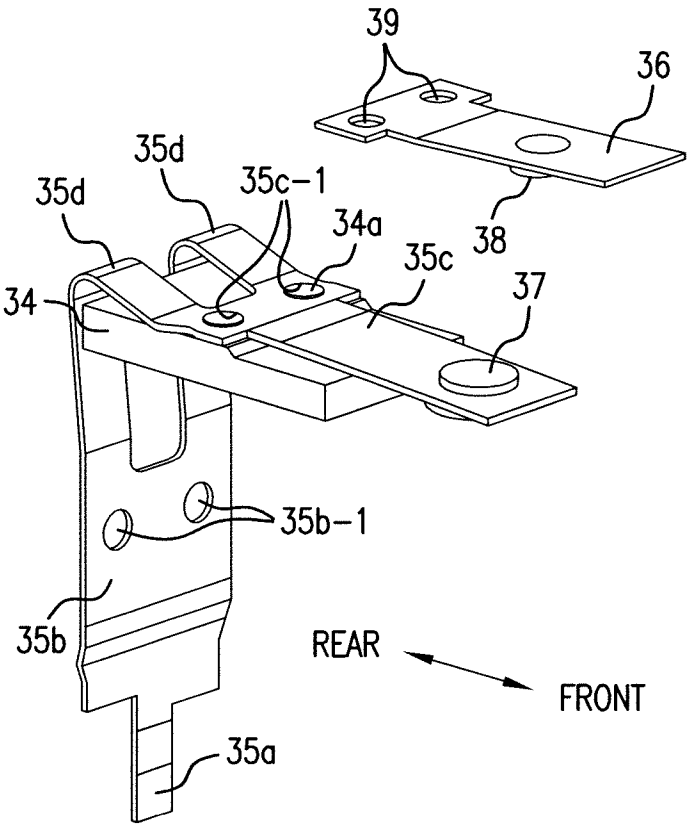
FIG. 4A is a perspective view illustrating a first movable spring and a second movable spring.

FIG. 4A is a perspective view illustrating the first movable spring 35 and the second movable spring 36. FIG. 4B is a perspective view illustrating a variation of the first movable spring 35 and the second movable spring 36.

As shown in FIG. 4A, the first movable spring 35 is a conductive plate spring member formed by punching a thin plate of phosphorus bronze for a spring and bending the punched thin plate in a substantially L-shape, for example. The first movable spring 35 integrally includes: a terminal part 35*a* that passes through the base block 2 and is fixed to the substrate; a vertical part 35*b* that is fixed to a rear surface of the yoke 33 by caulking, for example; a flat part 35*c* that is fixed to an upper surface of the armature 34 by caulking, for example; and a pair of right and left hinge spring parts 35*d* bent in a U-shape and connected between the vertical part 35*b* and the flat part 35*c*.

Moreover, the first movable spring 35 includes a first movable contact 37 formed at a position of the flat part 35*c* opposite to the first fixed contact 24. Through-holes 35*b*-1 for fixing the first movable spring 35 to the yoke 33 by caulking are formed on the vertical part 35*b*, and through-holes 35*c*-1 for fixing the first movable spring 35 to projections 34*a* of the armature 34 by caulking are formed on a rear end of the flat part 35*c*.

The second movable spring 36 is punched from the thin plate of the phosphorus bronze for the spring, and has substantially the same shape as the flat part 35*c* of the first movable spring 35. Also, the second movable spring 36 has the elastic member 38 pressing the flat part 35*c*. Moreover, through-holes 39 for fixing the second movable spring 36 to the projections 34*a* of the armature 34 by caulking along with the first movable spring 35 are formed on a rear end of the second movable spring 36.

The elastic member 38 is made of a material softer than the material of the first movable spring 35 and the second moving spring 36. The elastic member 38 is a rubber, a porous sponge, porous urethane or the like, for example, and a material that is resistant to heat and generates little outgas is preferred. The elastic member 38 is disposed between the first movable spring 35 and the second moving spring 36, prevents the second moving spring 36 from contacting the flat part 35*c* of the first movable spring 35, and absorbs the vibration of the first movable spring 35. As illustrated in FIG. 4B, the elastic member 38 may be formed on the flat part 35*c* of the first movable spring 35.

Before the operation of the electromagnetic relay 1, i.e., before the energization of the electromagnet, the elastic member 38 may be in contact with both of the first movable spring 35 and second movable spring 36. Thus, after the first movable contact 37 is in contact with the first fixed contact 24, it is possible to suppress the vibration of the first movable spring 35 quickly.

By fitting the elastic member 38 into the through-hole formed on the second movable spring 36 or the flat part 35*c*, the elastic member 38 may be fixed on the second movable spring 36 or the flat part 35*c*. The elastic member 38 may be fixed on the second movable spring 36 or the flat part 35*c* with an adhesive.

Figure 5A:
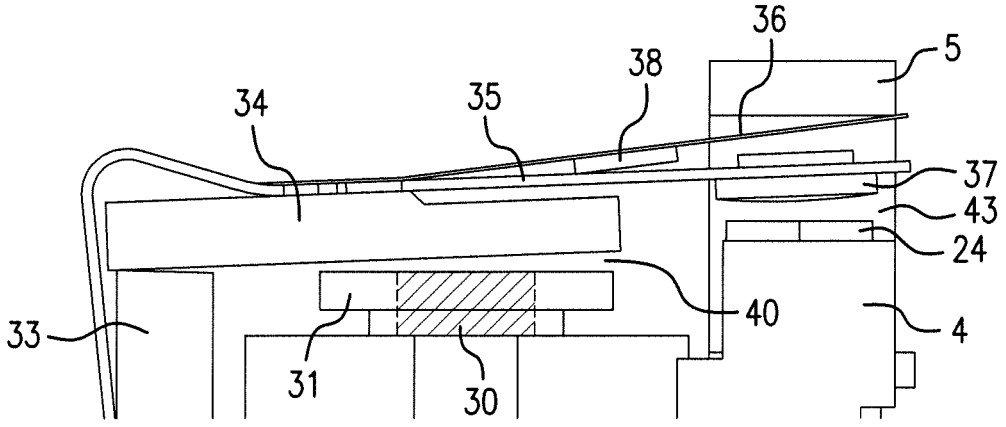
FIGS. 5A to 5C are diagrams illustrating operating states of the first movable spring and the second movable spring.
Figure 5B:
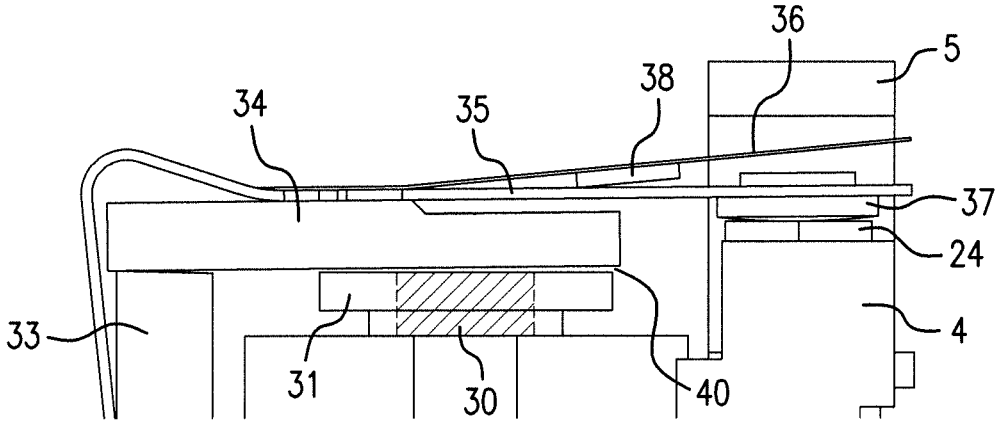
Figure 5C:
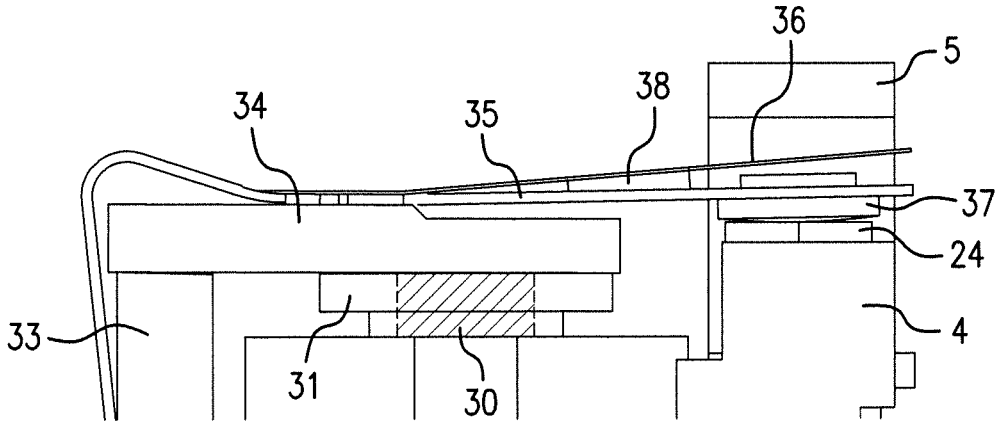

FIGS. 5A to 5C are diagrams illustrating operating states of the first movable spring 35 and the second movable spring 36.

When the electromagnet is not energized, a gap 40 is formed between the iron core 30 and the armature 34, and a gap 43 is formed between the first movable contact 37 and the first fixed contact 24, as illustrated in FIG. 5A. The first movable contact 37 and the first fixed contact 24 are configured as so-called make contacts. In the normal time, the first movable contact 37 and the first fixed contact 24 are in an open state. In the operating time, the first movable contact 37 and the first fixed contact 24 are in a closed state.

When the electromagnet is energized and the armature 34 is attracted to the iron core 30, the first movable spring 35 and the second movable spring 36 move downward along with the armature 34, and the first movable contact 37 is in contact with the first fixed contact 24, as illustrated in FIG. 5B. At this time, the gap 40 still exists between the iron core 30 and the armature 34. When the armature 34 is further attracted to the iron core 30, the armature 34 is in contact with the iron core 30 and the gap 40 is lost, as illustrated in FIG. 5C.

When the energization to the electromagnet is released, the electromagnetic relay shifts from the state of FIG. 5C to the state of FIG. 5B. That is, the armature 34 is separated from the iron core 30 by a biasing force of the first movable spring 35, and hence the gap 40 is formed between the iron core 30 and the armature 34. When the armature 34 is further separated from the iron core 30 by the biasing force of the first movable spring 35, the first movable contact 37 is separated from the first fixed contact 24, and the gap 43 is formed between the first movable contact 37 and the first fixed contact 24, as illustrated in FIG. 5A.

A period of time until the armature 34 is in contact with the iron core 30 after the first movable contact 37 is in contact with the first fixed contact 24 by the energization of the electromagnet is referred to as "follow". During the follow, the armature 34 moves downward until being in contact with the iron core 30, and the second movable spring 36 also moves downward by the same amount as a movement amount of the armature 34. However, since the first movable contact 37 is supported by the first fixed contact 24, deflection occurs in the first movable spring 35, and hence the movement amount of the first movable spring 35 is smaller than those of the second movable spring 36 and the armature 34. By a difference between the movement amounts, the elastic member 38 disposed between the first movable spring 35 and the second movable spring 36 presses the first movable spring 35. For this reason, it is possible to suppress the vibration of the first movable spring 35 generated by the collision of the first movable contact 37 and the first fixed contact 24 and the collision of the iron core 30 and the armature 34, to reduce the vibration to be transmitted from the first movable spring 35 to the substrate, not shown, and to reduce the sound to be generated from the substrate.

As described above, according to the first embodiment, the elastic member 38 disposed between the first movable spring 35 and the second movable spring 36 suppresses the vibration of the first movable spring 35, and can suppress the vibration to be transmitted from the electromagnetic relay 1 to the substrate on which the electromagnetic relay 1 is mounted.

Second Embodiment

Figure 6A:
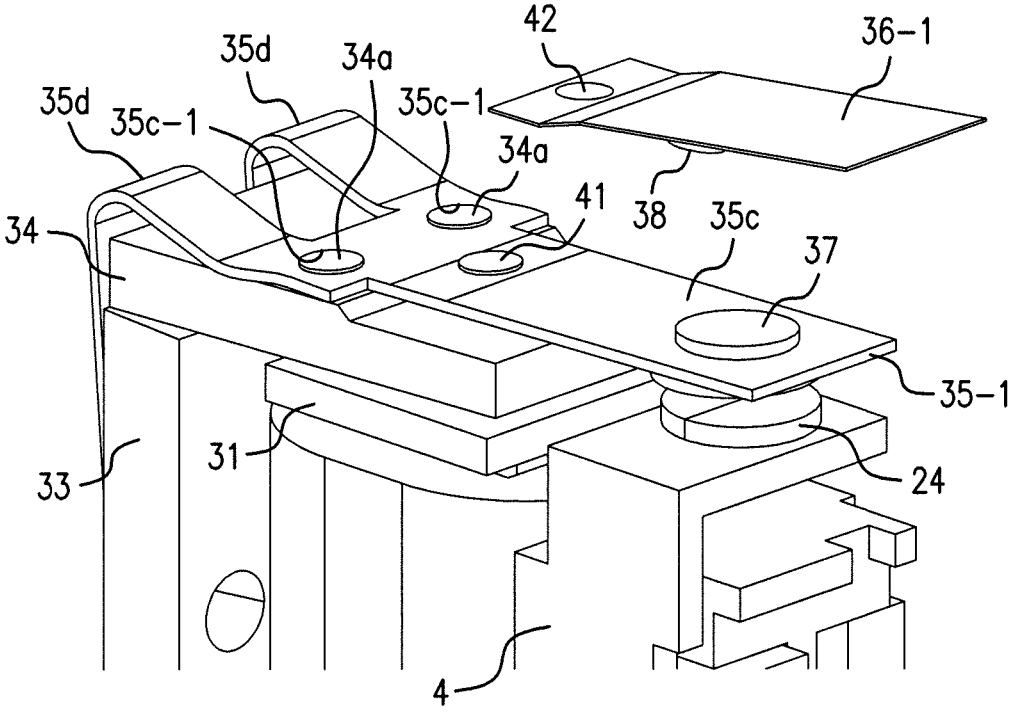
FIG. 6A is a diagram illustrating a first variation of the first movable spring and the second movable spring according to a second embodiment.
Figure 6B:
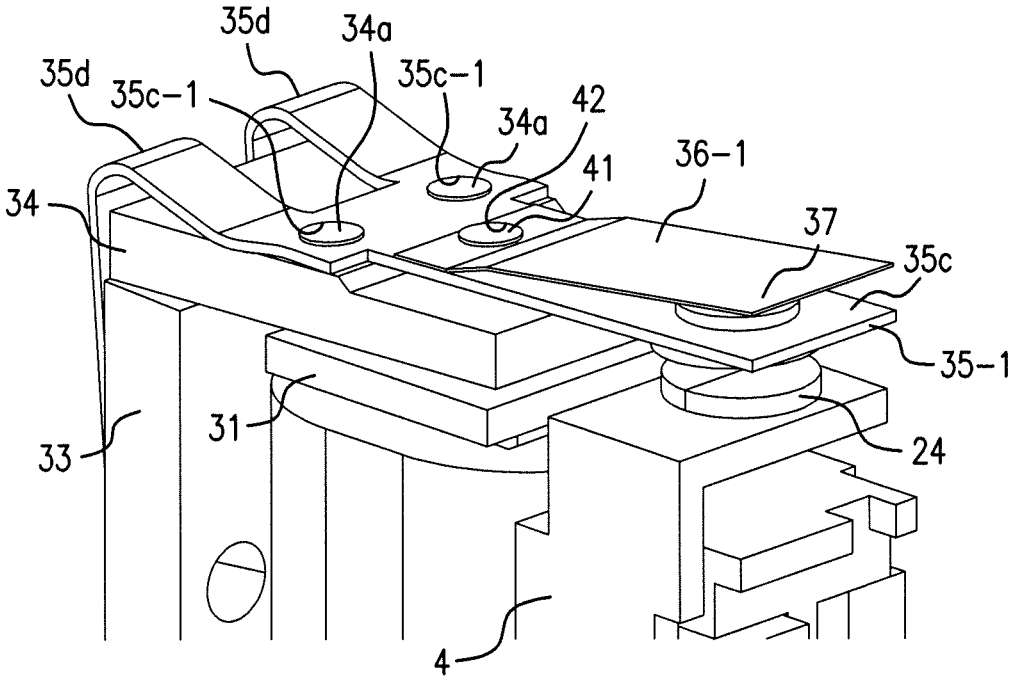
FIG. 6B is a diagram illustrating a state where the second movable spring is fixed on the first movable spring.

A second embodiment is different from the first embodiment in the structure of the first movable spring and the second movable spring. Elements identical with those in the first embodiment are designated by the same reference numbers, and description thereof is omitted. FIG. 6A is a diagram illustrating a first variation of the first movable spring and the second movable spring according to the second embodiment. FIG. 6B is a diagram illustrating a state where the second movable spring is fixed on the first movable spring.

In a first movable spring 35-1 of FIGS. 6A and 6B, a projection 41 for fixing a second movable spring 36-1 by caulking is formed on the flat part 35*c*. The projection 41 is formed forward than through-holes 35*c*-1 for fixing the first movable spring 35-1 to the protrusions 34*a* by caulking.

A second movable spring 36-1 is a rectangular flat plate, and is bent in a Z-shape in a side view. A through-hole 42 for fixing the second movable spring 36-1 to the projection 41 by caulking is formed on a rear end of the second movable spring 36-1.

By inserting the second movable spring 36-1 into the projection 41 of the first movable spring 35-1 and caulking the projection 41, the second movable spring 36-1 is fixed to the first movable spring 35-1. In this case, the second movable spring 36-1 can be easily fixed to the first movable spring 35-1 as compared with a case where the first movable spring 35 and the second movable spring 36 are doubly caulked to the armature 34. Here, through-holes are provide on both of the first movable spring and the second movable spring, and the first movable spring and the second movable spring can be coupled with each other by a rivet passing through the through-holes.

Third Embodiment

In a third embodiment, there are two sets of the movable contacts and the fixed contacts, and the third embodiment is different from the first embodiment in that the two sets of the movable contacts and the fixed contacts serve as so-called transfer contacts. Elements identical with those in the first embodiment are designated by the same reference numbers, and description thereof is omitted.

Figure 7A:
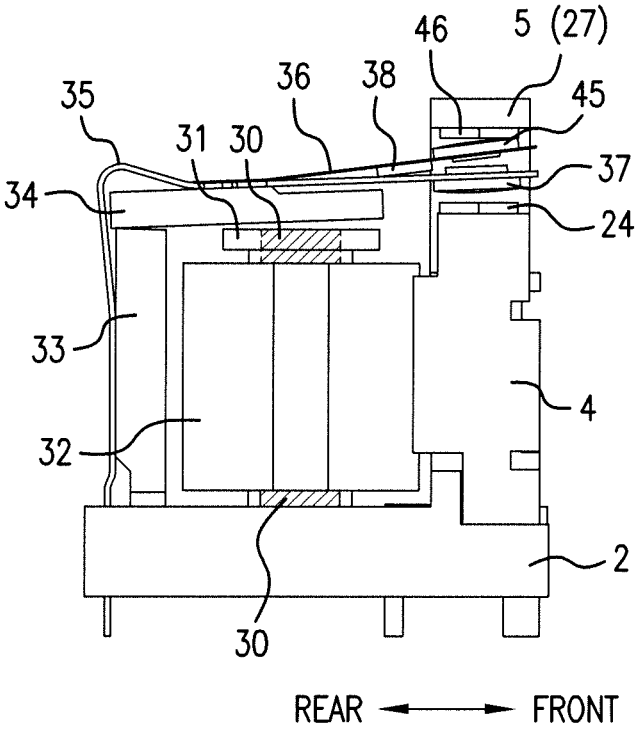
FIGS. 7A and 7B are side views of the electromagnetic relay according to a third embodiment.
Figure 7B:
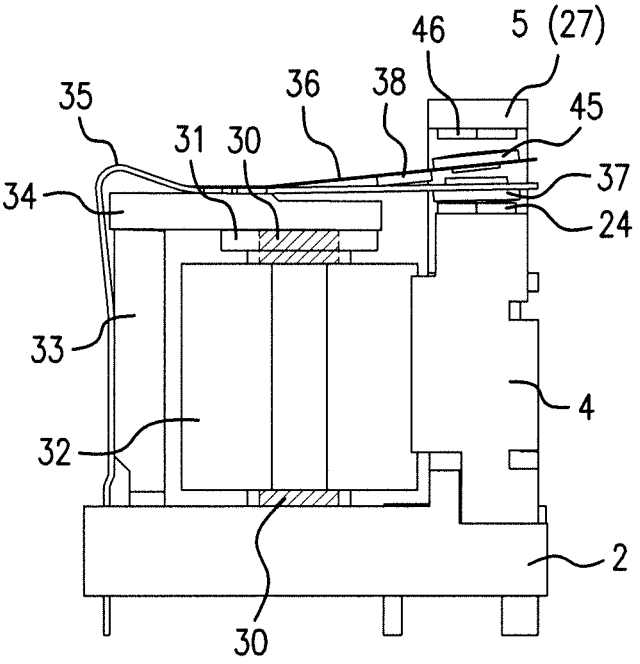

FIGS. 7A and 7B are side views of the electromagnetic relay according to the third embodiment. A second fixed contact 46 is formed on a lower surface of the flat plate part 27 of the second fixed terminal 5. A second movable contact 45 is formed on the second movable spring 36 so as to be opposite to the second fixed contact 46. The elastic member 38 is formed on the second movable spring 36. However, as long as the elastic member 38 is disposed between the first movable spring and the second movable spring 36, the elastic member 38 may be formed on the first movable spring 35.

The first fixed contact 24 and the second fixed contact 46 are opposite to each other, and the first movable contact 37 and the second movable contact 45 are located between the first fixed contact 24 and the second fixed contact 46.

When the electromagnet is not energized, the second movable contact 45 is in contact with the second fixed contact 46, and the first movable contact 37 is separated from the first fixed contact 24, as illustrated in FIG. 7A. When the electromagnet is energized, the armature 34 is attracted to the iron core 30, the first movable spring 35 and the second movable spring 36 move downward along with the armature 34, the second movable contact 45 is separated from the second fixed contact 46, and the first movable contact 37 is in contact with the first fixed contact 24, as illustrated in FIG. 7B. On the other hand, when the energization to the electromagnet is released, the electromagnetic relay shifts from the state of FIG. 7B to the state of FIG. 7A. That is, the armature 34 is separated from the iron core 30 by the biasing force of the first movable spring 35, the second movable contact 45 is in contact with the second fixed contact 46, and the first movable contact 37 is separated from the first fixed contact 24.

According to the third embodiment, when the electromagnet is energized, the second movable spring 36 moves downward by the same amount as the movement amount of the armature 34, the elastic member 38 disposed between the first movable spring 35 and the second movable spring 36 presses the first movable spring 35. For this reason, it is possible to suppress the vibration of the first movable spring 35 generated by the collision of the first movable contact 37 and the first fixed contact 24 and the collision of the iron core 30 and the armature 34, to reduce the vibration to be transmitted from the first movable spring 35 to the substrate, not shown, on which the electromagnetic relay 1 is mounted, and to reduce the sound to be generated from the substrate.

On the other hand, when the energization to the electromagnet is released, the elastic member 38 disposed between the first movable spring 35 and the second movable spring 36 presses the second movable spring 36 by the biasing force of the first movable spring 35. For this reason, it is possible to suppress the vibration of the second movable spring 36 generated by the collision of the second movable contact 45 and the second fixed contact 46, to reduce the vibration to be transmitted from the second moving spring 36 to the substrate, and to reduce the sound to be generated from the substrate.

Thus, according to the third embodiment, it is possible to suppress not only the vibration to be transmitted from the first movable spring 35 to the substrate but also the vibration to be transmitted from the second movable spring 36 to the substrate.

Fourth Embodiment

A fourth embodiment is different from the second embodiment in the structure of the first movable spring, the second movable spring and the elastic member. In the fourth embodiment, there are two sets of the movable contacts and the fixed contacts as with the third embodiment, and the two sets of the movable contacts and the fixed contacts serve as the so-called transfer contacts. Elements identical with those in the first to third embodiments are designated by the same reference numbers, and description thereof is omitted.

Figure 8A:
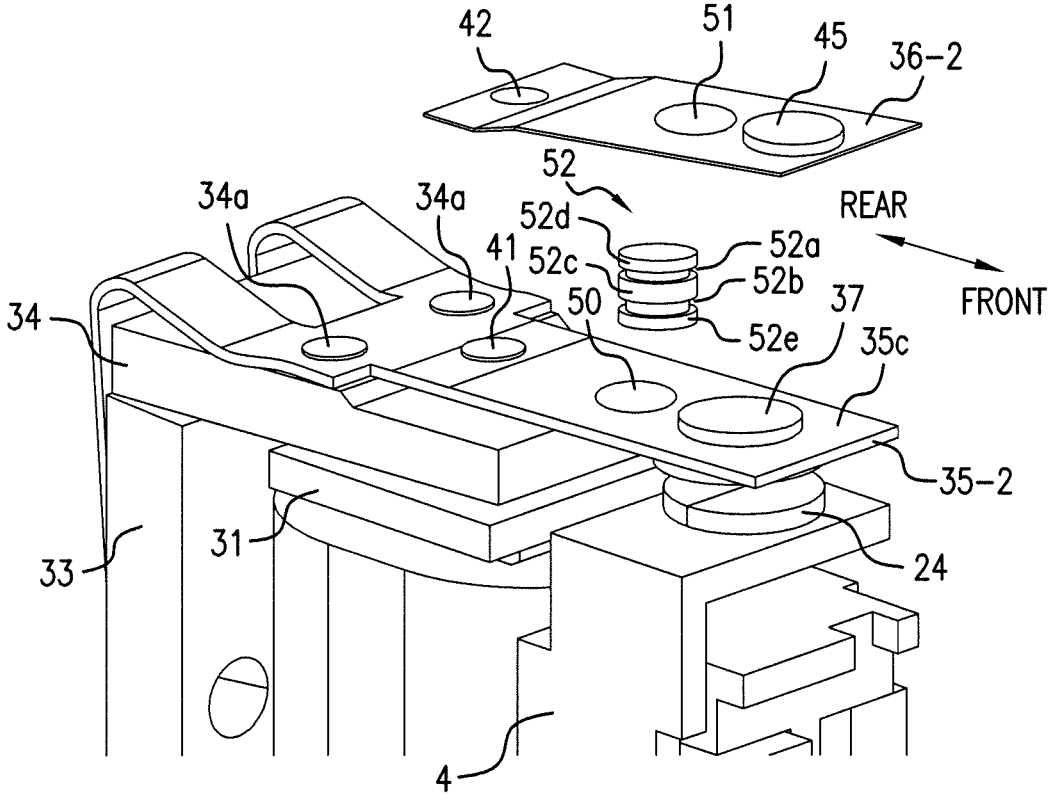
FIG. 8A is a diagram illustrating a second variation of the first movable spring and the second movable spring and a first variation of an elastic member according to a fourth embodiment.
Figure 8B:
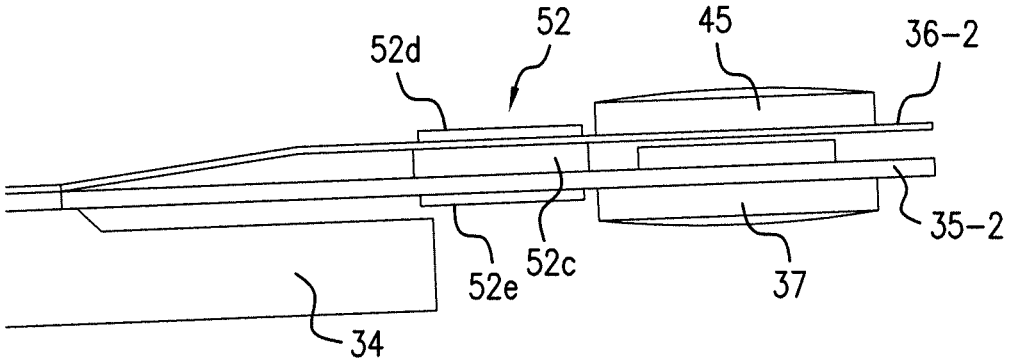
FIG. 8B is a diagram illustrating a state where the elastic member is attached to the first movable spring and the second movable spring.

FIG. 8A is a diagram illustrating a second variation of the first movable spring and the second movable spring and a first variation of an elastic member. FIG. 8B is a diagram illustrating a state where the elastic member is attached to the first movable spring and the second movable spring.

As illustrated in FIG. 8A, a through-hole 50 for mounting an elastic member 52 is formed on the flat part 35*c* of a first movable spring 35-2. The through-hole 50 is formed between the projection 41 and the first movable contact 37.

Moreover, a through-hole 51 for mounting the elastic member 52 is formed on a second movable spring 36-2. When the through-hole 42 of the second movable spring 36-2 is fixed to the projection 41 of the first movable spring 35-2, the through-hole 51 is opposite to the through-hole 50. The elastic member 52 is made of a material softer than the material of the first movable spring 35-2 and the second moving spring 36-2, and is the rubber, the porous sponge, the porous urethane or the like, for example.

A groove 52*a* for fixing the second movable spring 36-2 and a groove 52*b* for fixing the first movable spring 35-2 are formed on an outer circumference of the elastic member 52, as illustrated in FIG. 8A. The elastic member 52 includes a central part 52*c* and end parts 52*d* and 52*e* each of which has a diameter larger than each diameter of the grooves 52*a* and 52*b*.

The central part 52*c* and the end part 52*d* sandwich the second movable spring 36-2, and the central part 52*c* and the end part 52*e* sandwich the first movable spring 35-2. That is, the groove 52*a* between the central part 52*c* and the end part 52*d* is fitted into the through-hole 51 of the second movable spring 36-2, and the groove 52*b* between the central part 52*c* and the end part 52*e* is fitted into the through-hole 50 of the first movable spring 35-2. As illustrated in FIG. 8B, the elastic member 52 elastically connects the first movable spring 35-2 and the second movable spring 36-2 with each other.

According to the fourth embodiment, the elastic member 52 can suppress not only the vibration to be transmitted from the first movable spring 35-2 to the substrate, not shown, but also the vibration to be transmitted from the second moving spring 36-2 to the substrate, not shown. Only by fitting the groove 52*a* of the elastic member 52 into the through-hole 51 of the second movable spring 36-2 and fitting the groove 52*b* of the elastic member 52 into the through-hole 50 of the first movable spring 35-2, the elastic member 52 is fixed to the first movable spring 35-2 and the second movable spring 36-2, and hence the mounting of the elastic member 52 is easy.

Figure 9A:
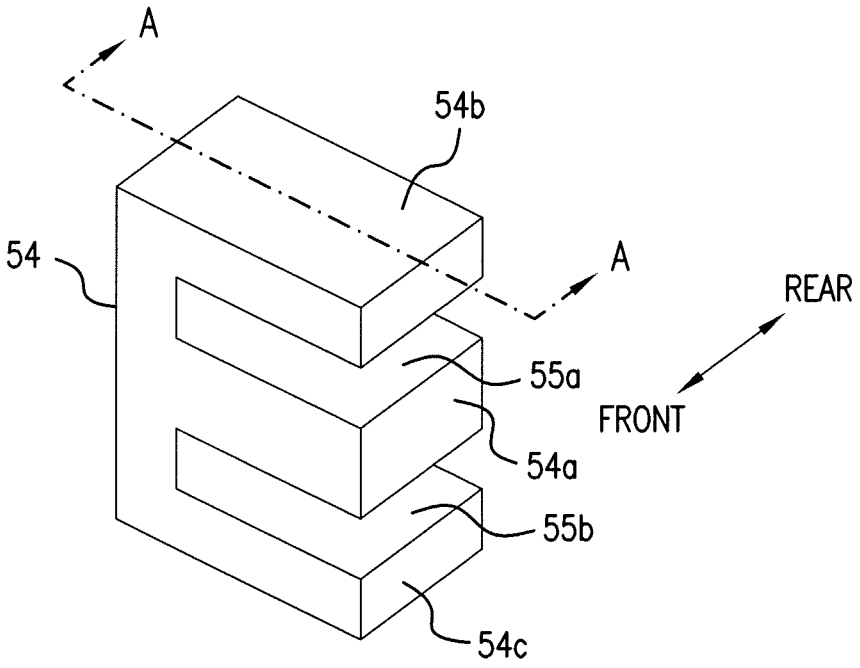
FIG. 9A is a diagram illustrating a second variation of the elastic member.
Figure 9B:
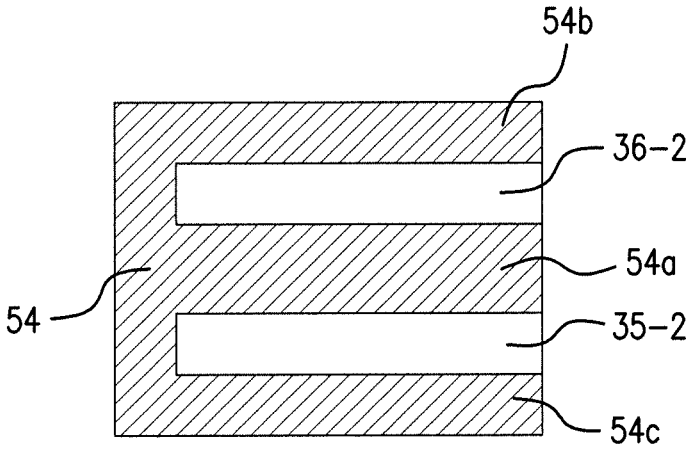
FIG. 9B is a cross-section diagram taken along line A-A in FIG. 9A.

FIG. 9A is a diagram illustrating a second variation of the elastic member. FIG. 9B is a cross-section diagram taken along line A-A in FIG. 9A.

As illustrated in FIG. 9A, an elastic member 54 having an E-shape in a front view may be used instead of the elastic member 52 of FIG. 8A. In this case, the elastic member 54 is the rubber, the porous sponge, the porous urethane or the like, for example, and includes a central part 54*a* and end parts 54*b* and 54*c*. A gap 55*a* is formed between the central part 54*a* and the end part 54*b*, and a gap 55*b* is formed between the central part 54*a* and the end part 54*c*. By inserting the second movable spring 36-2 into the gap 55*a*, the central part 54*a* and the end part 54*b* sandwich the second movable spring 36-2, as illustrated in FIG. 9B. By inserting the first movable spring 35-2 into the gap 55*b*, the central part 54*a* and the end part 54*c* sandwich the first movable spring 35-2, as illustrated in FIG. 9B.

When the elastic member 54 is used, it is not necessary to form the through-hole 51 on the second movable spring 36-2 and it is not necessary to form the through-hole 50 on the first movable spring 35-2. By inserting the first movable spring 35-2 and the second movable spring 36-2 from a right or left side, the elastic member 54 can fix the first movable spring 35-2 and the second movable spring 36-2, and therefore the mounting of the elastic member 54 is easy.

Figure 10:
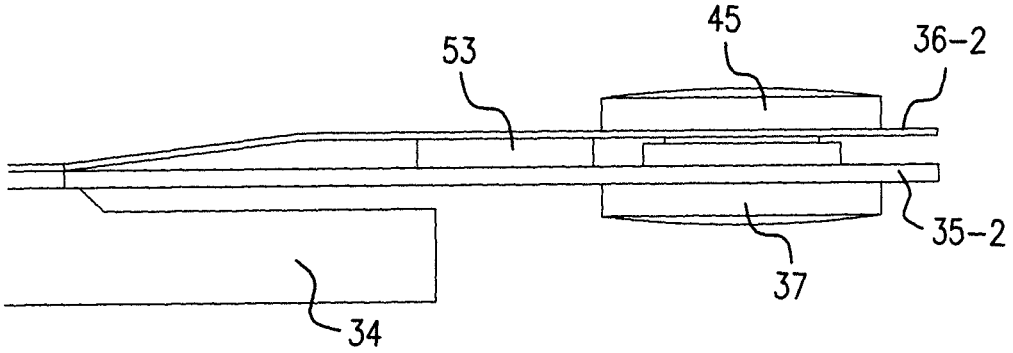
FIG. 10 is a diagram illustrating a third variation of the elastic member.

Moreover, an elastic member 53 having a viscosity (e.g. a rubber to which an adhesive is applied) may be provided instead of the elastic member 52, as illustrated in FIG. 10. The elastic member 53 connects the first movable spring and the second movable spring. In this case, it is not necessary to form the through-hole 51 on the second movable spring 36-2 and it is not necessary to form the through-hole 50 on the first movable spring 35-2. There is no fitting work in the through-hole unlike the elastic member 52, the elastic member 53 is pasted between the first movable spring 35-2 and the second movable spring 36-2, and therefore the mounting of the elastic member 53 is easy.

Fifth Embodiment

A fifth embodiment is different from the first embodiment (FIGS. 4A and 4B) in that the structure of the second movable spring 36 is the same as that of the flat part 35*c* of the first movable spring 35. In the fifth embodiment, there are two sets of the movable contacts and the fixed contacts as with the third embodiment, and the two sets of the movable contacts and the fixed contacts serve as the so-called transfer contacts. Elements identical with those in the first to fourth embodiments are designated by the same reference numbers, and description thereof is omitted.

Figure 11A:
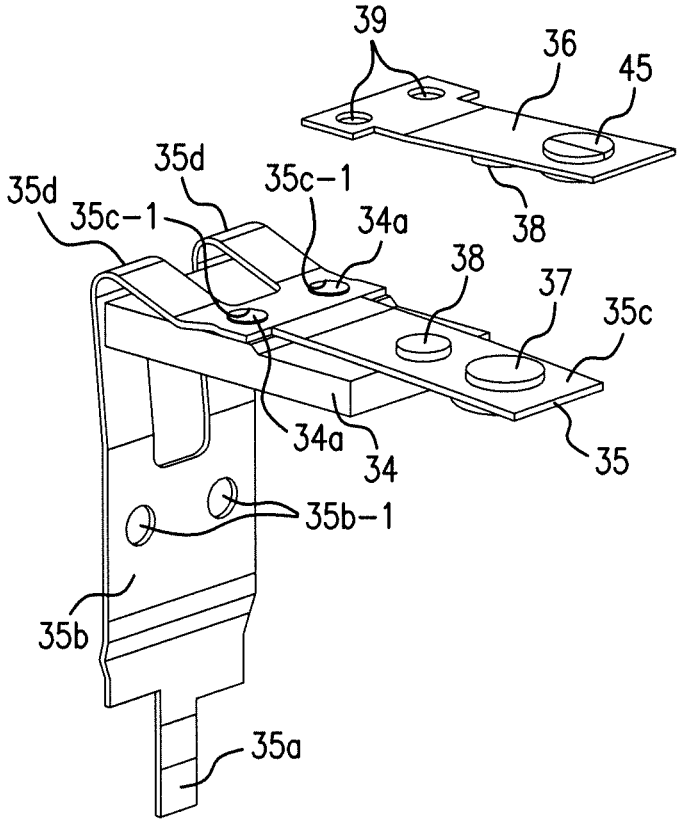
FIG. 11A is a perspective view illustrating the first movable spring and the second movable spring according to a fifth embodiment.
Figure 11B:
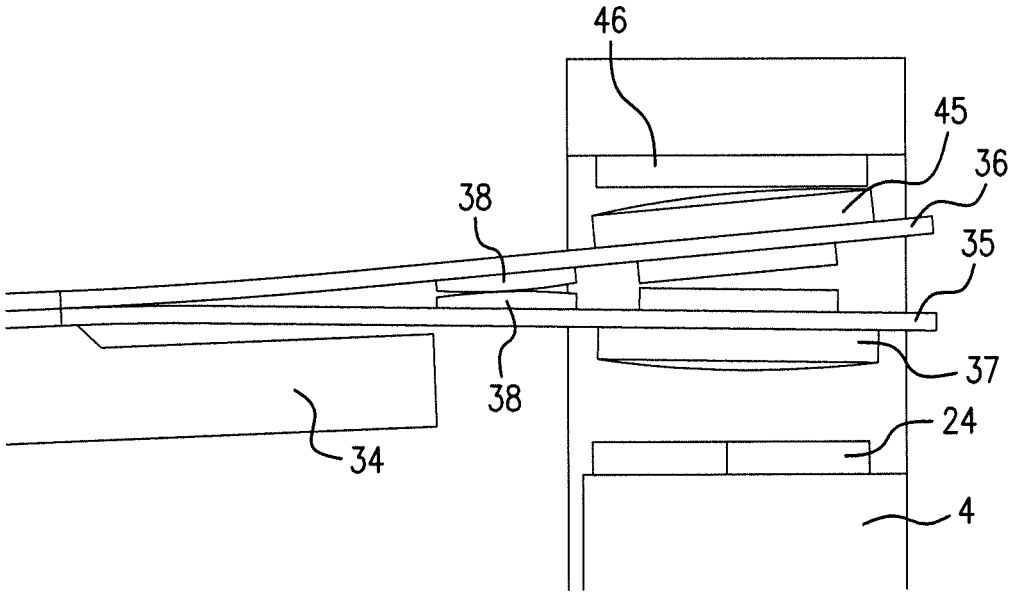
FIG. 11B is a side view illustrating a part of the first movable spring and the second movable spring.

FIG. 11A is a perspective view illustrating the first movable spring 35 and the second movable spring 36. FIG. 11B is a side view illustrating a part of the first movable spring 35 and the second movable spring 36.

The first movable spring 35 of FIGS. 11A and 11B is the same as the first movable spring 35 of FIG. 4B. The flat part 35*c* of the first movable spring 35 includes the through-holes 35*c*-1, the first movable contact 37 and the elastic member 38. On the other hand, the second movable spring 36 has the same shape as the flat part 35*c* of the first movable spring 35, and includes the through-holes 39, the second movable contact 45 and the elastic member 38.

The projections 34*a* of the upper surface of the armature 34 are inserted into the through-holes 39 of the second movable spring 36 and the through-holes 35*c*-1 of the first movable spring 35 and then are caulked. As a result, the first movable spring and the second movable spring 36 are fixed on the armature 34.

The elastic member 38 formed on the first movable spring 35 is in contact with the elastic member 38 formed on the second movable spring 36, and these elastic members 38 are sandwiched between the first movable spring 35 and the second movable spring 36. The first movable contact 37 is formed at a position opposite to the second movable contact 45.

Thus, since the structure of the second movable spring 36 is the same as the structure of the flat part 35*c* of the first movable spring 35, it is possible to simplify the design of the second movable spring 36 and reduce a manufacturing cost.

Figure 12A:
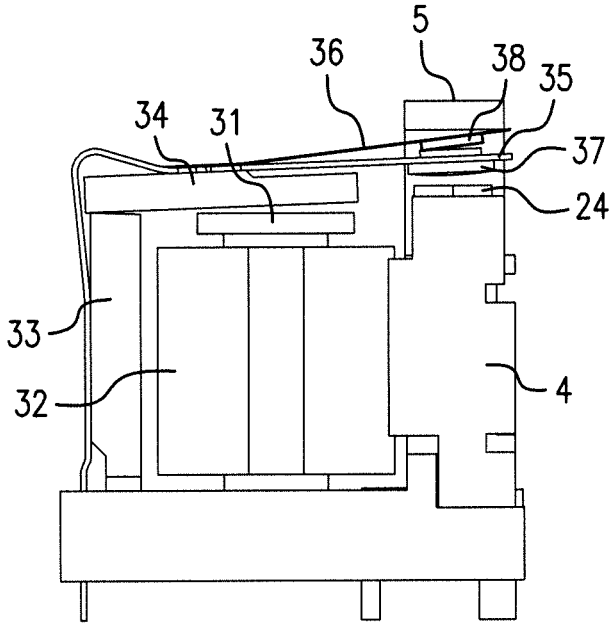
FIG. 12A is a view illustrating a first variation of the arrangement of the elastic member.
Figure 12B:
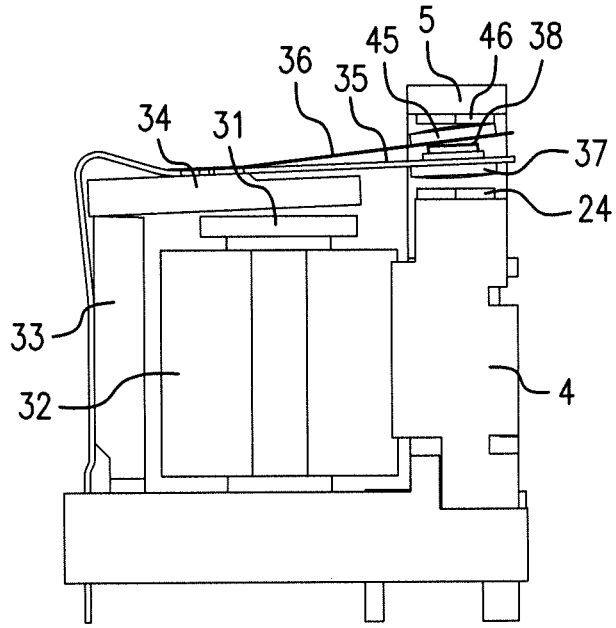
FIG. 12B is a view illustrating a second variation of the arrangement of the elastic member.

In the first to fifth embodiments, the elastic member 38 is disposed at the position of the first movable spring 35 or the second moveable spring 36 for not pressing the first movable contact 37 or the second movable contact 45. However, the elastic member 38 may be disposed at the position of the first movable spring 35 or the second moveable spring 36 for pressing at least one of the first movable contact 37 or the second movable contact 45, as illustrated in FIG. 12A. Alternatively, the elastic member 38 may be disposed between the first movable contact 37 and the second movable contact 45 so as to press the first movable contact 37 and the second movable contact 45, as illustrated in FIG. 12B.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. An electromagnetic relay comprising:
- an electromagnet;
- an armature that swings by energization and non-energization of the electromagnet;
- a first fixed terminal on which a first fixed contact is mounted;
- a first movable spring on which a first movable contact opposite to the first fixed contact is mounted, and that is fixed to the armature;
- a second movable spring that moves along with the first movable spring in response to the swinging of the armature; and
- an elastic member that is mounted on at least one of the first movable spring and the second movable spring, and is disposed between the first movable spring and the second movable spring,
- wherein the first movable spring and the second movable spring are fixed to a same position of the armature, and are separated from each other along a swinging direction of the armature.

2. The electromagnetic relay as claimed in claim 1, wherein
- the elastic member is in contact with both of the first movable spring and the second movable spring before the energization of the electromagnet.

3. The electromagnetic relay as claimed in claim 1, wherein
- the second movable spring is mounted on the armature along with the first movable spring.

4. The electromagnetic relay as claimed in claim 1, further comprising:
- a second fixed terminal on which a second fixed contact is mounted;
- wherein a second movable contact opposite to the second fixed contact is mounted on the second movable spring.

5. The electromagnetic relay as claimed in claim 1, wherein
- the elastic member includes:
- a central part disposed between the first movable spring and the second movable spring;
- a first end part that sandwiches the first movable spring along with the central part; and
- a second end part that sandwiches the second movable spring along with the central part.

* * * * *